US009027811B1

(12) United States Patent
Cannon

(10) Patent No.: US 9,027,811 B1
(45) Date of Patent: May 12, 2015

(54) HANDGUN HOLSTER

(71) Applicant: Martin A. Cannon, Crescent, IA (US)

(72) Inventor: Martin A. Cannon, Crescent, IA (US)

( * ) Notice: Subject to any disclaimer, the term of this patent is extended or adjusted under 35 U.S.C. 154(b) by 0 days.

(21) Appl. No.: 13/971,134

(22) Filed: Aug. 20, 2013

(51) Int. Cl.
*F41C 33/04* (2006.01)

(52) U.S. Cl.
CPC ..... *F41C 33/041* (2013.01); *F41C 33/04* (2013.01); *Y10S 224/911* (2013.01); *Y10S 224/912* (2013.01)

(58) Field of Classification Search
USPC ..... 224/587, 192, 193, 195, 911, 912
See application file for complete search history.

(56) References Cited

U.S. PATENT DOCUMENTS

| | | | | | |
|---|---|---|---|---|---|
| 4,084,734 | A * | 4/1978 | Bianchi et al. | ..... | 224/192 |
| 4,577,787 | A * | 3/1986 | Hersey | ..... | 224/243 |
| 4,815,641 | A * | 3/1989 | Bianchi et al. | ..... | 224/238 |
| 5,170,919 | A * | 12/1992 | DeSantis et al. | ..... | 224/587 |
| 5,410,762 | A | 5/1995 | Maskovich | | |
| 5,829,653 | A | 11/1998 | Kaiser | | |
| 5,909,834 | A * | 6/1999 | Parrott, III | ..... | 224/587 |
| 6,402,001 | B1 * | 6/2002 | Madarang | ..... | 224/587 |
| 8,371,487 | B1 | 2/2013 | Plappert | | |
| 2002/0139825 | A1 * | 10/2002 | Madarang | ..... | 224/587 |
| 2006/0196907 | A1 | 9/2006 | Pruitt | | |

* cited by examiner

*Primary Examiner* — Brian D Nash
(74) *Attorney, Agent, or Firm* — Dennis L. Thomte; Thomte Patent Law Office LLC

(57) ABSTRACT

A holster for securing a handgun to a wearer's body by way of a belt. The holster includes a body member having a central body portion which has an endless elastic loop member extending therearound. The body member has a first belt opening at one side of the central body portion and a second belt opening at the other side of the central body portion.

16 Claims, 6 Drawing Sheets

HANDGUN HOLSTER

BACKGROUND OF THE INVENTION

1. Field of the Invention

This invention relates to a handgun holster and more particularly to a concealed carry handgun holster.

2. Description of the Related Art

Many different holsters have been previously provided for use with handguns. When a holster is going to be used for a concealed carry handgun, the holster must be small and comfortable. Further, the holster must securely maintain the handgun in the holster to prevent the handgun from falling therefrom. Further, the holster must permit ready access to the handgun and to enable easy removal of the handgun from the holster. Many concealed carry handgun holsters have utilized a single elastic strap to hold the handgun in place but those elastic straps wear quite quickly and due to the single strap construction thereof, it has limited elasticity. Additionally, when the handgun has a magazine catch button or magazine release button which extends outwardly from the frame of the handgun, the prior art holsters may cause the button to be depressed thereby causing the magazine to be ejected from the handgun.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The holster of this invention includes a body member having a central portion with an upper end, a lower end, a first side, a second side, an inner side and an outer side. A first wing extends horizontally laterally from the upper end of the central portion of the body member at the first side thereof. A second wing extends horizontally laterally from the upper end of the central portion at the second side thereof. A third wing extends horizontally laterally from the lower end of the central portion at the first side thereof. A fourth wing extends horizontally laterally from the lower end of the central portion at the second side thereof.

A vertically disposed first end member is secured to and extends between the first and third wings thereby creating a first belt opening between the first side of the central portion of the body member and the first end member. A vertically disposed second end member is secured to and extends between the second and fourth wings thereby creating a second belt opening between the second side of the central portion of the body member and the second end member. An elastic loop member embraces the central portion of the body member between the wings.

The central portion of the body member has at least one opening and preferably two openings formed therein. The central portion of the body member may also have four openings formed therein. The barrel of the handgun may be inserted downwardly between the outer side of the central portion of the body member and the front portion of the elastic loop member. When the handgun is inserted into the holster, the magazine catch or release button of the hand gun is received in one of the openings formed in the central portion of the body member.

In use, the insertion of the handgun into the holster will automatically cause the elastic loop member to longitudinally migrate or float somewhat so that any worn portions of the outer portion of the loop member will be shifted towards the inner side of the central portion of the body member. The elastic loop member may also be manually shifted or rotated with respect to the central portion of the body member so that the worn portion of the elastic loop member may be positioned at the inner side of the central portion of the body member. The elastic loop member provides greater elasticity than a single elastic strap. The holster may also be worn at the right side of the wearer or the left side of the wearer. Further, the holster may be rotated 180 degrees.

A second embodiment of the invention is also described.

It is therefore a principal object of the invention to provide an improved handgun holster.

A further object of the invention is to provide a concealed carry handgun holster of the type described which prevents the magazine catch or release button of the handgun from being depressed, when the handgun is inserted into the holster, thereby preventing the magazine of the handgun from being ejected therefrom.

A further object of the invention is to provide a concealed carry handgun holster which utilizes an endless elastic loop member which may be rotated or shifted should a portion of the loop member become worn.

A further object of the invention is to provide a handgun holster of the type described which is not only comfortable to wear but which permits easy access to the handgun and provides easy withdrawal of the handgun from the holster.

A further object of the invention is to provide a handgun holster of the type described which may be rotated 180 degrees so that the upper end of the elastic loop member becomes the lower end of the elastic loop member and vice versa, thereby extending the wear life of the elastic loop member.

Still another object of the invention is to provide a handgun holster of the type described which may be worn on the right side or the left side of the wearer.

Yet another object of the invention is to provide a handgun holster of the type described wherein the elastic loop member thereof automatically longitudinally shifts somewhat during insertion of the handgun into the holster and during withdrawal of the handgun from the holster thereby extending the wear life of the elastic loop member.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
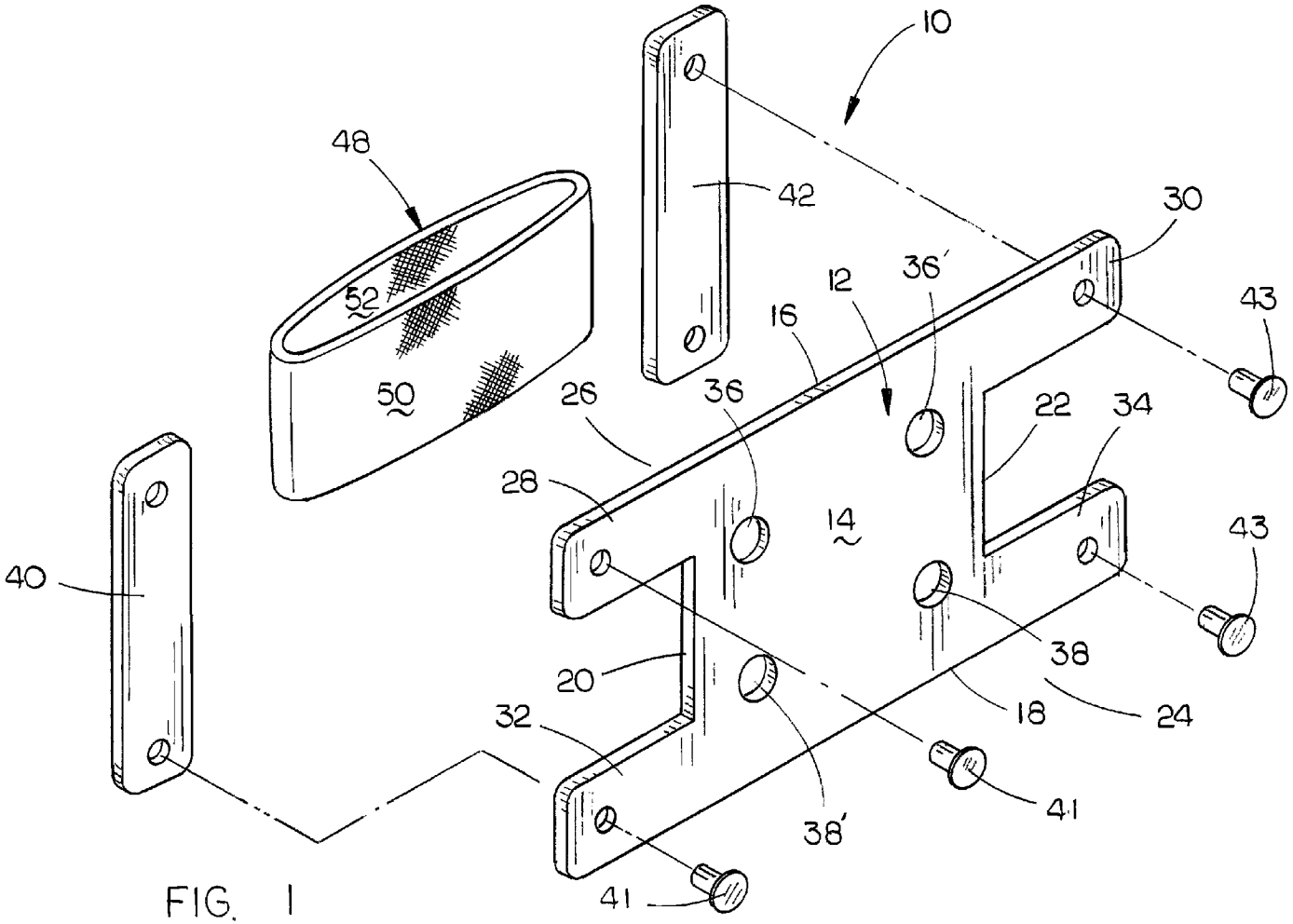
FIG. 1 is an exploded perspective view of the first embodiment of the holster of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The first embodiment of the concealed carry handgun holster of this invention is designated by the reference numeral 10 and is preferably comprised of a flexible leather material although other materials may be used. Holster 10 includes a body member 12 having a central body portion 14. Central body portion 14 will be described as having an upper end 16, a lower end 18, a first side 20, a second side 22, an outer side 24 and an inner side 26. Body member 12 has a wing 28 which extends horizontally laterally from the upper end of central body portion 14 at the first side 20 thereof. Body member 12 also has a wing 30 which extends horizontally laterally from the upper end of central body portion 14 at the second side 22 thereof. Further, body member 12 has a wing 32 which extends horizontally laterally from the lower end of central body portion 14 at the first side 20 thereof. Additionally, body member 12 has a wing 34 which extends horizontally laterally from the lower end of central body portion 14 at the second side 22 thereof. Preferably, central body portion 14 has at least one opening 36 formed therein and preferably another opening 38 formed therein. Preferably, central body portion 14 also has an opening 36' and an opening 38' formed therein.

A flexible end member 40 is secured to and extends between the inner sides of wings 28 and 32 by rivets 41, glue, etc. A flexible end member 42 is secured to and extends between the inner sides of wings 30 and 34 by rivets 43, glue, etc.

Figure 2:
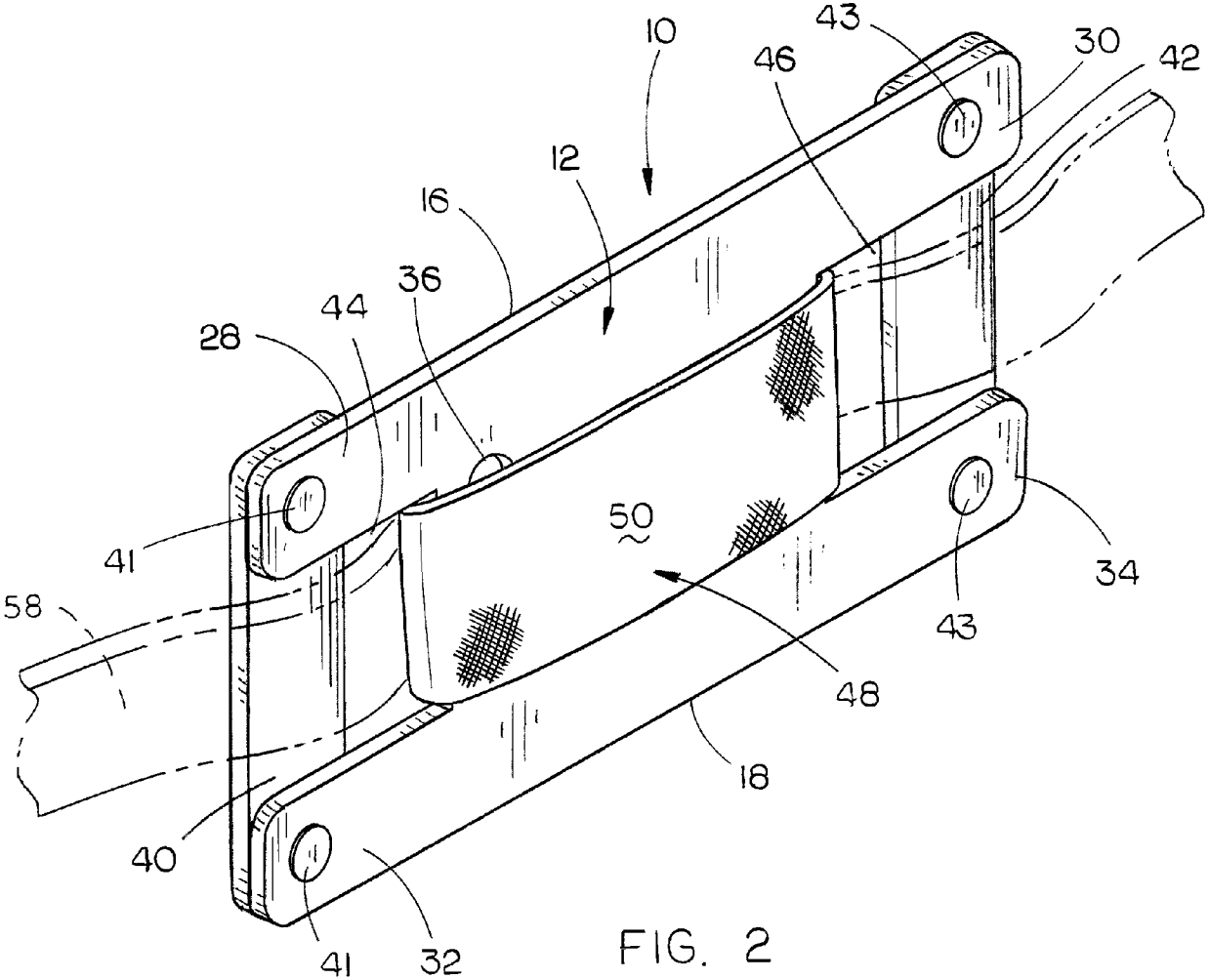
FIG. 2 is a perspective view of the holster of FIG. 1 with the broken lines illustrating a portion of a wearer's belt onto which the holster is mounted.

As seen in FIG. 2, end member 40 is spaced from central body portion 14 to define a belt opening 44 therebetween. As also seen in FIG. 2, end member 42 is spaced from central body portion 14 to define a belt opening 46. The numeral 48 refers to an elastic loop member which embraces central body portion 14 between the wings, as seen in the drawings. For purposes of description, loop member 48 will be described as having an outer portion 50 and an inner portion 52. The numeral 54 refers to a handgun including a barrel 56 and a magazine catch button or magazine release button (not shown).

The holster 10 of this invention is assembled and used as follows. Prior to end members 40 and 42 being secured to wings 28, 32, and 30, 34, the elastic loop member is stretched and slipped onto the sides 20 and 22 of central body portion 14. End member 40 is then secured to wings 28 and 32 at the inner sides thereof as described hereinabove. End member 42 is then secured to wings 30 and 34 at the inner sides thereof as also described hereinabove.

Figure 3:
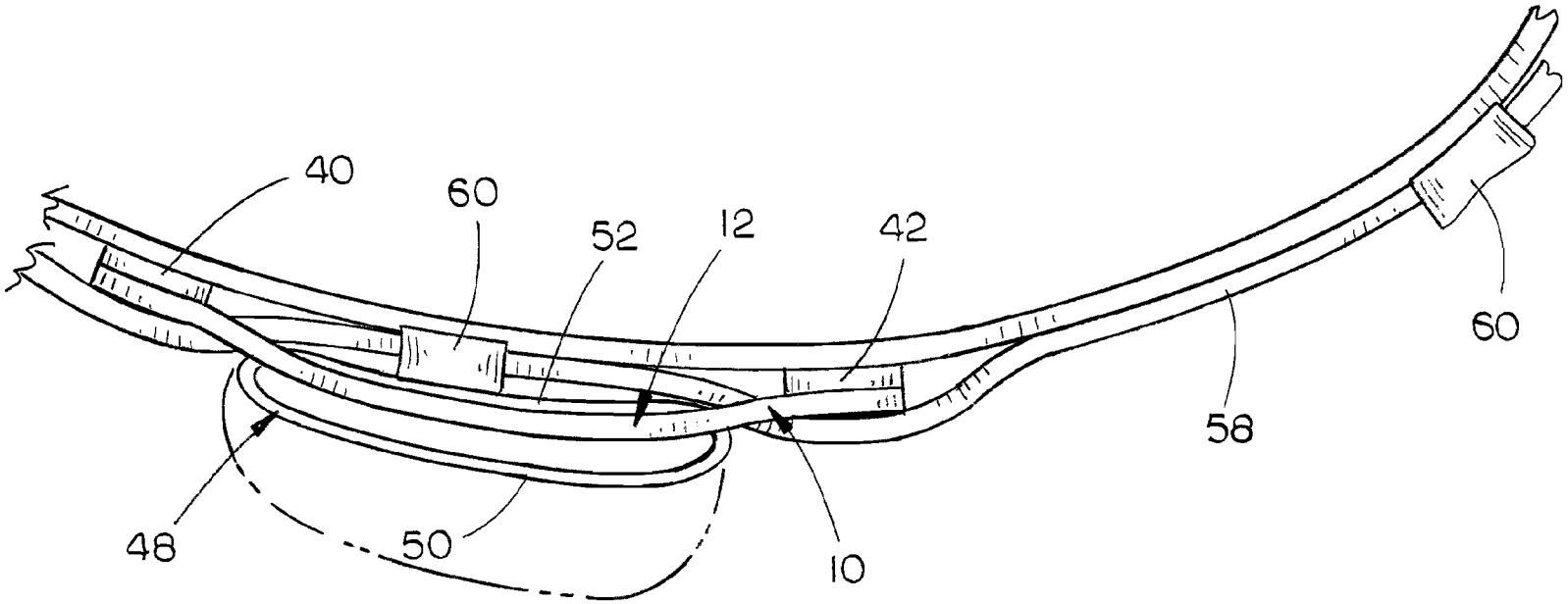
FIG. 3 is a top view of the holster of FIG. 1 mounted on a wearer's belt with the outer portion of the loop member being stretched outwardly from the central portion of the body member and with the broken lines illustrating the outer portion of the elastic loop member being stretched outwardly to permit a handgun to be inserted into the holster.
Figure 4:
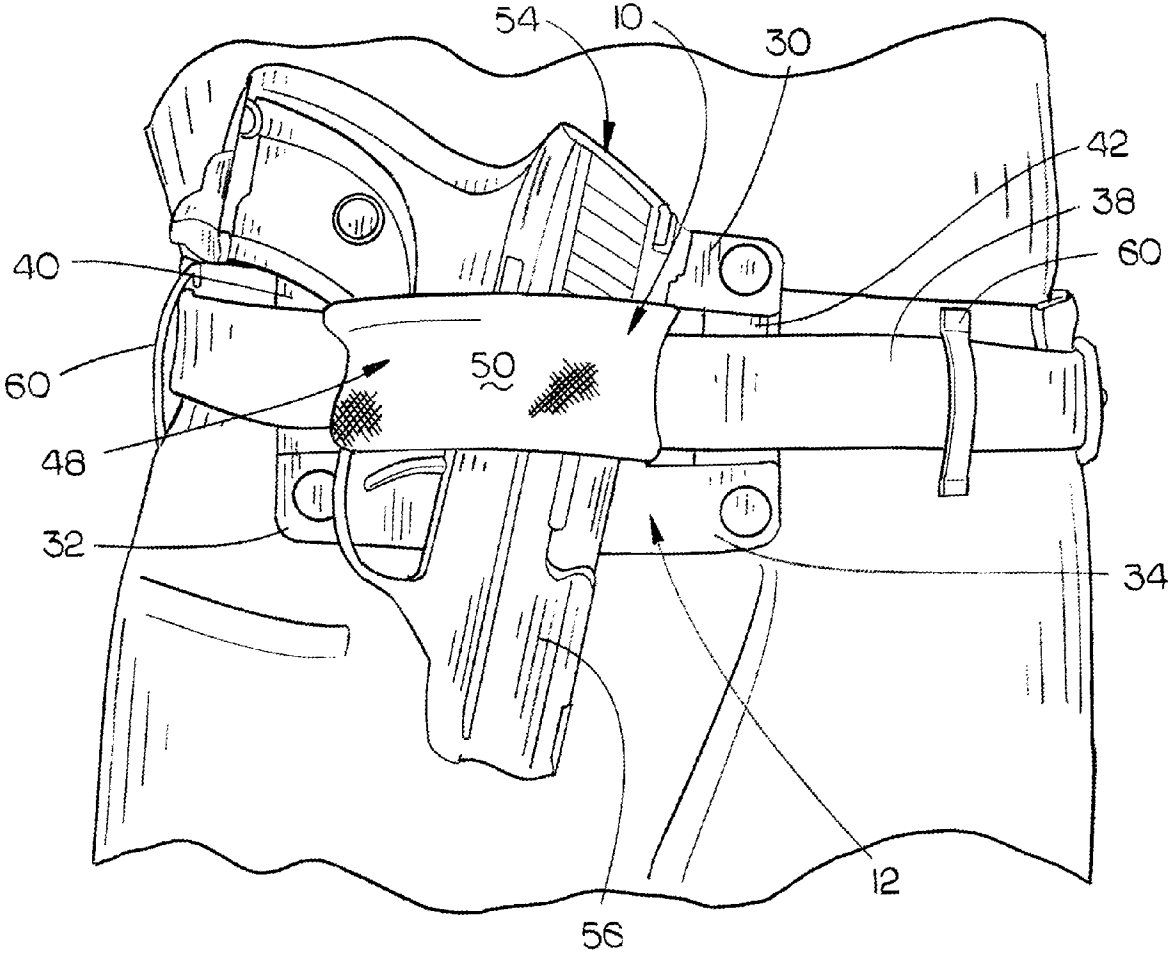
FIG. 4 is a perspective view illustrating a handgun inserted into the holster of this invention.

When the holster is going to be used, the free end of the wearer's belt 58 is extended inwardly through the belt opening 44. The belt 58 is then moved laterally towards the belt opening 46 and then passed outwardly through belt opening 46, as seen in FIG. 2. The free end of the belt 58 is then threaded through one or more belt loops 60 of the wearer's trousers or pants and secured to the belt buckle. If desired, the belt 58 may be threaded through one of the wearer's belt loops 60 between the belt openings 44 and 46, as seen in FIG. 3, which will limit the movement of the holster 10 relative to the wearer's belt. When the handgun 54 is to be inserted into the holster 10, the outer portion 50 of loop member 48 is grasped by the wearer and pulled outwardly from the outer side 24 of central body portion 14, as illustrated by the broken lines in FIG. 3. The barrel 56 of the handgun is then inserted downwardly into the loop member 48 between the outer portion 50 and central body portion 14. The tension of the loop member 48 is then released so that the loop member 48 securely maintains the handgun 54 in the holster 10. The fact that the loop member 48 is of the endless loop type rather than a single elastic strap provided greater elasticity to the device.

When the handgun 54 is positioned in the holster 10, the magazine catch button or magazine release button is then received by the opening 36 or the opening 38 so that pressure is not applied to the button thereby preventing the button from being depressed which could cause the magazine of the handgun from being ejected.

If the holster 10 is rotated 180 degrees, the magazine catch button or magazine release button thereof is received by the opening 36' or the opening 38' so that pressure is not applied to the button thereby preventing the button from being depressed which could cause the magazine of the handgun from being ejected. The openings 36, 36', 38 and 38' also permit the holster 10 to be mounted on the left side of the wearer and to permit the holster 10 to be rotated 180 degrees since many of the buttons of various handguns extend outwardly from both sides of the handgun.

If the outer portion 50 of loop member 48 becomes worn through use, the loop member 48 may be manually shifted or rotated relative to the central body member 12 so that the outer portion 50 becomes the inner portion of the loop member 48 and so that the outer portion of the loop member 48 becomes the inner portion. Further, the repeated insertion of the handgun into the holster also causes the elastic loop member 48 to migrate, shift or rotate somewhat so that worn portions of the outer loop portion 50 are moved towards the inner side of central body portion 14.

The holster 10 of this invention enables the handgun to be easily inserted into the holster 10 and easily withdrawn therefrom. The design of the holster 10 also permits easy and ready access to the handgun in the holster.

Figure 5:
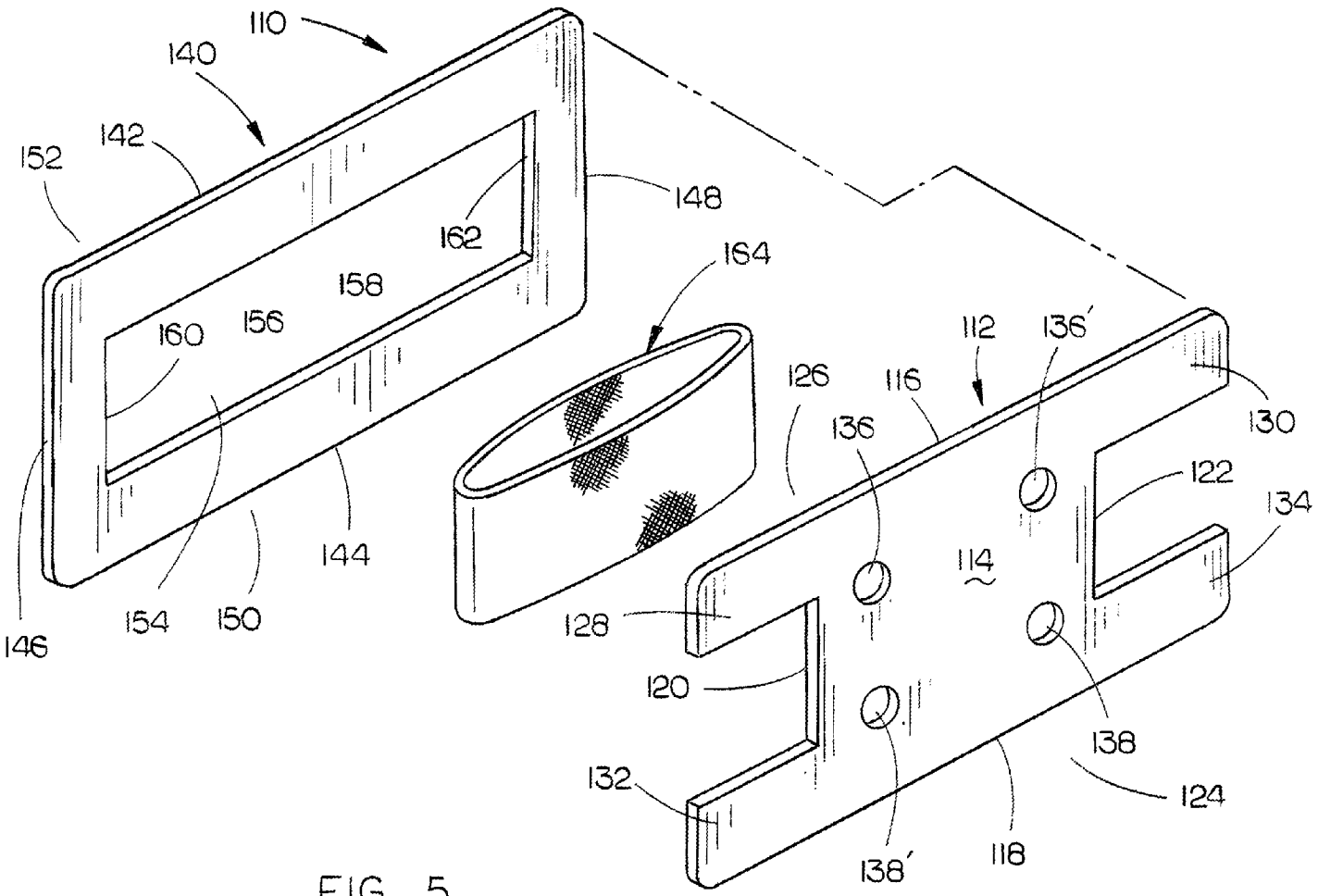
FIG. 5 is an exploded perspective view of a second embodiment of this invention.
Figure 6:
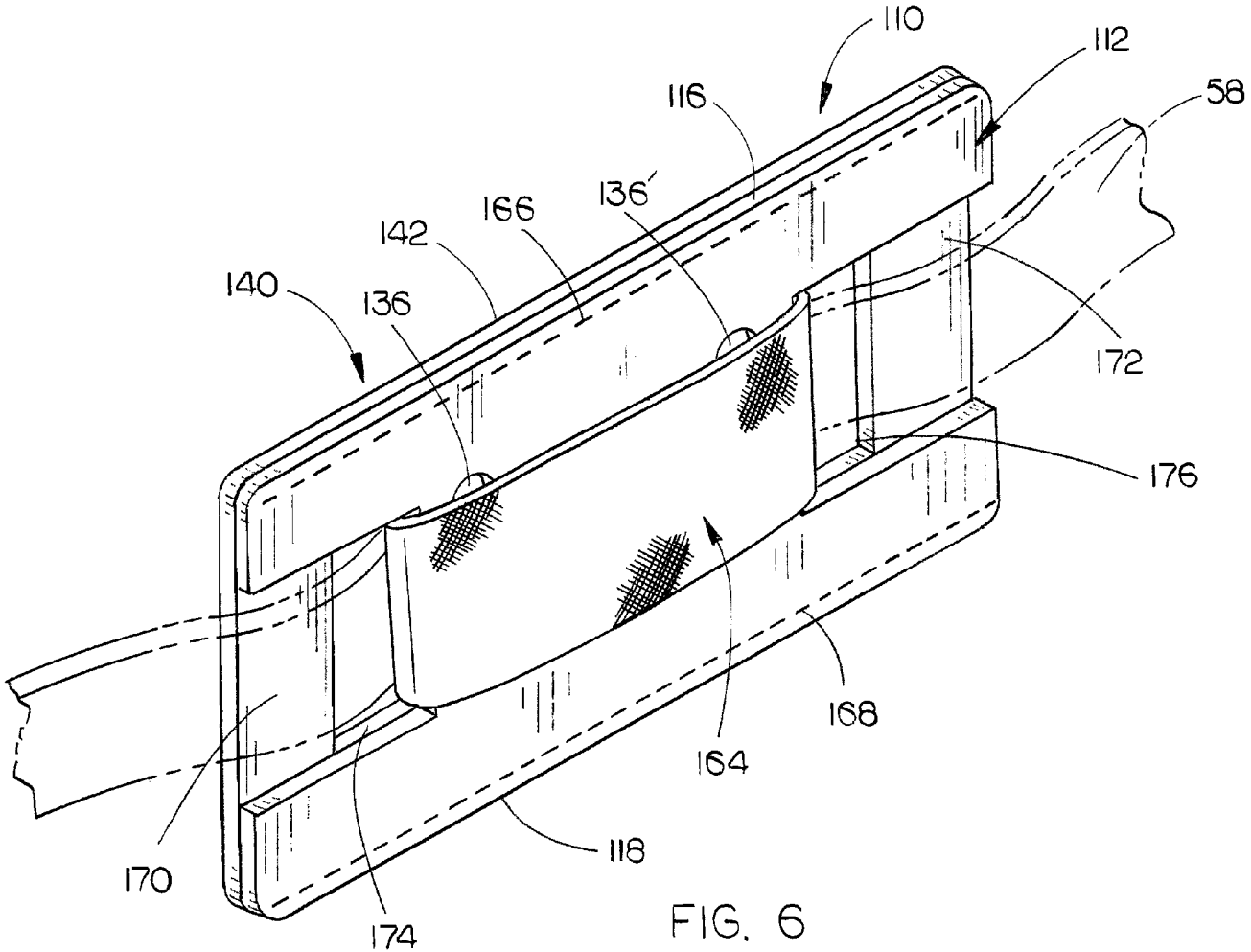
FIG. 6 is a perspective view of the holster of FIG. 5 with the broken lines illustrating a portion of the wearer's belt onto which the holster is mounted.

A second embodiment of the invention is illustrated in FIGS. 5 and 6 and designated by the reference numeral 110. Holster 110 is comprised of a generally rectangular outer body member 112 having a central body portion 114. Central body portion 114 will be described as having an upper end 116, a lower end 118, a first side 120, a second side 122, an outer side 124 and an inner side 126. Body member 112 has a wing 128 which extends horizontally laterally from the upper end of central body portion 114 at the first side 120 thereof. Body member 112 also has a wing 130 which extends horizontally laterally from the upper end of central body portion 114 at the second side 122 thereof. Further, body member ?? has a wing 132 which extends horizontally laterally from the lower end of central body portion 114 at the first side 120 thereof. Additionally, body member 112 has a wing 134 which extends horizontally laterally from the lower end of central body portion 114 at the second side 122 thereof. Preferably central body portion 114 has at least one opening 136 formed therein and preferably has another opening 138 formed therein. Preferably, central body portion 114 also has an opening 136' and an opening 138' formed therein.

Holster 110 also includes a generally rectangular inner body member 140 which will be described as having an upper end 142, a lower end 144, a first side 146, a second side 148, an outer side 150 and an inner side 152. Body member 140 has a central opening 154 formed therein which will be described as having an upper end 156, a lower end 158, a first side 160 and a second side 162.

The holster 110 is assembled as will now be described. An elastic loop member 164 is mounted on body member 112 so as to embrace central body portion 114. The outer side of body member 140 is then placed against the inner side of body member 112. The upper portion of body member 112 is then stitched to body member 140 at 166. The lower portion of body member 112 is then stitched to the lower portion of body member 140 at 168. The joining of body members 112 and 140 together creates an end member 170 and an end member 172. The end member 170 is spaced from side 120 of central body portion 114 to create a belt opening 174. The end ember 172 is spaced from side 122 of central body portion 114 to create a belt opening 176.

The holster 110 is used in the same fashion as holster 10.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A holster for securing a handgun to a wearer's body by way of a belt, comprising:

a body member including a central body portion having an upper end, a lower end, a first side, a second side, an inner side, and an outer side;

a first wing, having inner and outer sides, extending laterally from said upper end of said central body portion at said first side thereof;

a second wing, having inner and outer sides, extending laterally from said upper end of said central body portion at said second side thereof;

a third wing, having inner and outer sides, extending laterally from said lower end of said central body portion at said first side thereof;

a fourth wing, having inner and outer sides, extending laterally from said lower end of said central body portion at said second side thereof;

a first end member extending between said first and third wings thereby creating a first belt opening between said first end member and said first side of said central body portion;

a second end member extending between said second and fourth wings thereby creating a second belt opening between said second end member and said second side of said central body portion;

and an endless elastic loop member embracing said central body portion to define an outer loop portion at said outer side of said central body portion and an inner loop portion at said inner side of said central body portion;

said outer loop portion of said endless elastic loop member being selectively movable away from said outer side of said central body portion to permit the barrel of a handgun to be inserted downwardly between said outer side of said central body portion and said outer loop portion.

2. The holster of claim 1 wherein said elastic loop member is selectively moveable with respect to said central body portion.

3. The holster of claim 1 wherein said body member is comprised of a flexible leather material.

4. The holster of claim 1 wherein said central body portion has at least one magazine catch button opening formed therein.

5. The holster of claim 1 wherein said first end member is positioned at the inner sides of said first and third wings wherein said second end member is positioned at the inner sides of said second and fourth wings.

6. The holster of claim 1 wherein said end members are comprised of a flexible leather material.

7. The holster of claim 1 wherein said body member is comprised of a flexible material.

8. The holster of claim 1 wherein said end members are comprised of a flexible material.

9. The holster of claim 1 wherein said wings are comprised of a flexible material.

10. The holster of claim 1 wherein said wings are comprised of a flexible leather material.

11. A holster for securing a handgun to a wearer's body by way of a belt, comprising:

a generally rectangular body member having a first end, a second end, an upper end, a lower end, an outer side and an inner side;

a first belt receiving slot formed in said body member inwardly of said first end of said body member;

a second belt receiving slot formed in said body member inwardly of said second end of said body member;

an endless elastic loop member extending through said first and second belt receiving slots and extending therebetween to define an elastic outer loop portion positioned at said outer side of said body member and an elastic inner loop portion positioned at said inner side of said body member;

said elastic outer loop portion being movable by the wearer outwardly from said outer side of said body member to create a space between said elastic outer loop portion and said outer side of said body member for receiving a portion of a handgun therein.

12. The holster of claim 11 wherein said elastic loop member is selectively movably received by said first and second slots.

13. The holster of claim 11 wherein said body is comprised of a flexible material.

14. The holster of claim 13 wherein said flexible material is comprised of leather.

15. The holster of claim 11 wherein said body member is comprised of an outer body portion and an inner body portion.

16. The holster of claim 15 wherein said inner and outer body portions are secured together.

* * * * *